US009067235B1

(12) United States Patent
Smith et al.

(10) Patent No.: US 9,067,235 B1
(45) Date of Patent: Jun. 30, 2015

(54) CAULKING GUN AUXILIARY ASSEMBLY

(71) Applicants: Samuel J. Smith, Wichita, KS (US); Ray A. Hoch, Wichita, KS (US)

(72) Inventors: Samuel J. Smith, Wichita, KS (US); Ray A. Hoch, Wichita, KS (US)

( * ) Notice: Subject to any disclaimer, the term of this patent is extended or adjusted under 35 U.S.C. 154(b) by 0 days.

(21) Appl. No.: 14/144,246

(22) Filed: Dec. 30, 2013

(51) Int. Cl.
*B05C 17/02* (2006.01)
*B05C 17/03* (2006.01)

(52) U.S. Cl.
CPC ..... *B05C 17/0325* (2013.01); *B05C 17/0308* (2013.01); *B05C 17/0316* (2013.01)

(58) Field of Classification Search
USPC ..... 401/176, 179, 181, 182, 208, 218, 219, 401/220, 197
See application file for complete search history.

(56) References Cited

U.S. PATENT DOCUMENTS

| | | | | |
|---|---|---|---|---|
| 2,892,439 | A | 6/1959 | Dynia | |
| 3,981,595 | A * | 9/1976 | Blake | 401/48 |
| 5,482,189 | A | 1/1996 | Dentler et al. | |
| 5,496,123 | A * | 3/1996 | Gaither | 401/176 |
| 5,875,928 | A * | 3/1999 | Muller et al. | 222/82 |
| 7,815,384 | B2 * | 10/2010 | Parks et al. | 401/47 |

* cited by examiner

*Primary Examiner* — David Walczak
(74) *Attorney, Agent, or Firm* — Kenneth H. Jack; Davis & Jack, L.L.C.

(57) ABSTRACT

A paint applicator attachable to a caulking gun including a cradle, a stop fixedly attached to the cradle's front end, a bar, a plate fixedly attached to the bar's front end, and ratchet mechanism including a pivotable grip operatively positioning the bar's front end and the plate within the cradle for forwardly moving the plate, the paint applicator incorporating cylinder having a hollow bore and a front wall, the cylinder being fitted for insertion into the cradle; a nipple opening the cylinder at the cylinder's front wall; a piston mounted within the cylinder; a clamp nut adapted for resisting removal of the cylinder from the cradle; a yoke having a hollow bore, and having paint inlet and paint outlet ends; a rotatable coupling nut adapted for attaching the yoke to the nipple; and a paint roller rotatably mounted upon the yoke's outlet end for receiving and rollably applying the paint.

12 Claims, 7 Drawing Sheets

CAULKING GUN AUXILIARY ASSEMBLY

CLAIM OF PRIORITY FROM PREVIOUSLY FILED PROVISIONAL PATENT APPLICATION

This non-provisional patent application claims the benefit of and priority from U.S. provisional patent application No. 61/747,447 filed Dec. 31, 2012. The inventors and applicants of said provisional application are the same as those of the instant application, and the specifications and drawings are substantially identical.

FIELD OF THE INVENTION

This invention relates to handheld caulking guns. More particularly, this invention relates to assemblies constituting auxiliary caulking gun components which are adapted for enhancing a caulking gun's function.

BACKGROUND OF THE INVENTION

Painting contractors who perform conventional steps of painting exteriors of commercial or residential buildings often preliminarily perform caulking wherein a common handheld caulking gun loaded with a caulk filled caulking tube is utilized for filling and sealing gaps, crevices, and seams within the wall surfaces of the building. Upon completion of such caulking step, such contractor normally sets such caulking gun aside, leaving it idle. Thereafter, wall surfaces painting proceeds through use of separate and often expensively provided painting equipment.

A common post-caulk application painting step includes detailed painting of the building's eve, wall, and window trim features. Such painting step is conventionally performed through use of a paint roller, which typically undesirably requires that the painting contractor repeatedly make trips to and form a paint roller pan containing paint for reloading of the paint roller with paint.

The instant inventive auxiliary assembly solves or ameliorates the problems discussed above by providing specially configured and adapted structures which are useable as caulking gun auxiliary components which allow the caulking gun to perform substantially continuous and uninterrupted wall and trim roller painting.

BRIEF SUMMARY OF THE INVENTION

The instant inventive auxiliary assembly is preferably configured for use with a handheld caulking gun of the type which has a caulking tube receiving and retaining cradle or bracket, such cradle or bracket having front and rear ends. In a preferably utilized caulking gun, the front end of the gun's caulking tube receiving cradle forms a tube stopping and retaining element which holds a caulking tube within the cradle by resisting forward sliding motion of the caulking tube with respect to cradle. In a preferred embodiment, such stopping element forms an upwardly opening "U" slot for caulking tube nipple clearance, such slot conventionally allowing a caulking tube's applicator nipple to extend forwardly from the caulking gun.

The instant inventive auxiliary assembly is preferably utilized with the type of caulk gun which has a ram bar which is slidably mounted at the rear of a tube cradle, such mount preferably being adapted for facilitating reciprocating forward and rearward motions of the ram bar. A plunger driving plate is preferably fixedly and removably attached to the forward end of the ram bar. Ratcheting means for forcefully and incrementally moving the ram bar and its plunger plate forwardly along the cradle are preferably provided, such means preferably being actuated by a pivoting finger grip assembly mounted at the rear of the tube cradle.

In normal and conventional operation of a caulking gun such as is described above, the gun's ram bar and attached plunger plate may be initially rearwardly retracted to clear the interior of the cradle for insertion of a caulking tube. Thereafter, a caulking tube is conventionally inserted into the interior of the cradle and is positioned so that the caulking tube's forward applicator nipple extends forwardly from the caulking gun's forward end. Thereafter, the caulking gun's plunger driving ratchet may be actuated to forcefully and progressively move the ram bar and plunger plate forwardly along the cradle. Such motion causes the plunger plate to enter the caulking tube's open rearward end, and to compressively impinge against the caulking tube's interior piston or plunger. Continued application of forwardly directed pressure by the plunger plate against the tube's plunger drives the viscous caulk contents of the tube forwardly along the tube's interior, causing the caulk to dispense from the open forwardly end of the caulking tube's applicator nipple.

Following completion of caulking operations through use of the above described caulking gun, a painting contractor may initially rearwardly retract the caulking gun's ram bar and plunger plate to remove the caulking tube from the caulking gun's cradle. Thereafter, a cylinder component of the instant inventive assembly may be installed in place of the caulking tube.

Such cylinder constitutes a first structural component of the instant inventive auxiliary caulk gun assembly, the cylinder preferably having a substantially rigid and thin wall which defines a paint reservoir. The cylinder component preferably has a substantially circular cross-sectional shape and is closely fitted to match the size and shape of a standard caulk tube, such fitting allowing the cylinder to be nestingly received within the caulk gun's cradle. A rearward end of the cylinder is preferably opened, and the forward end preferably forms an annular inwardly extending shelf or wall.

A further structural component of the instant inventive auxiliary assembly comprises a hollow bored nipple which is fixedly attached to and extends forwardly from the cylinder's annular forward wall. In a preferred embodiment, the nipple's hollow bore communicates with the cylinder's hollow interior for facilitating flows of liquid paint into and out of the cylindrical paint reservoir.

A further structural component of the instant inventive auxiliary assembly comprises a paint drawing and driving piston or plunger which is closely fitted for sealed and reciprocating sliding motion within the cylinder's bore.

A further structural component of the instant inventive auxiliary assembly comprises first attaching means which are adapted for facilitating secure attachments and detachments of the cylinder and nipple combination to and from the caulking gun's cradle. Preferably, the first attaching means comprise a combination of helical threads extending about the exterior of the cylinder's nipple and a matchingly threaded clamping nut. Upon insertion of the cylinder into the caulking gun's cradle and upon forward extension of the cylinder's nipple through the cradle's front wall slot, the clamping nut may securely clamp and hold the cradle's front wall between the clamping nut and the cylinder's front wall. The first attaching means may suitably, though less desirably, alternatively comprise various commonly known forms of annular clamps and binders which may directly hold the cylinder within the caulking gun's cradle. For example, retainer flanges, circumferentially extending straps, or circumferentially spanning over-center latches and clips may be alternatively used to hold the cylinder within the cradle.

A further structural component of the instant inventive auxiliary assembly comprises a paint roller, roller spindle, and roller yoke combination of the type which is adapted for conveying liquid paint through a hollow conduit within the yoke, thence into a hollow paint receiving chamber within the spindle, and thence outwardly to the paint roller's nap, such roller, spindle and yoke combination being the type manufactured by the Wagner, and Black and Decker companies.

Second attaching means, preferably in the form of a rotatable coupling nut are provided, such means preferably being mounted at the yoke's rearward end. In a preferred embodiment, such second attaching means preferably further comprise and incorporate a forward extension of the helical threads which are utilized for mounting the first attaching means' preferred clamping nut. The second attaching means may suitably alternatively comprise a quick disconnect coupler. In the preferred embodiment, the second mounting means securely and removably attach the roller, spindle, and yoke combination to the cylinder's nipple.

A further structural component of the instant inventive auxiliary assembly comprises third attaching means which are adapted for releasably connecting the invention's plunger component to a caulking gun's plunger plate or to forward end of the gun's ram bar. In a preferred embodiment, the third attaching means comprise slot and retainer ridge combinations wherein the retainer ridges are fixedly attached to an annular flange or wall which extends rearwardly from the plunger, and wherein the slots open radially outwardly from the plunger plate's circumferential edge, such combination being further described below. Other commonly known releasable attaching means such as helically threaded joints and snap ridge and snap channel combinations may be suitably alternatively utilized for releasably attaching the caulking gun's ram bar to the assembly's plunger component.

A further preferred structural component of the instant inventive assembly comprises a combination of a flexible paint drawing tube and fourth attaching means which are fixedly mounted to such tube's rearward end. In the preferred embodiment, such fourth attaching means are configured substantially identically with the invention's second attaching means, the fourth attaching means allowing the paint drawing tube to be interchangeably attached to the assembly's nipple component.

In use of the instant inventive auxiliary assembly, the cylinder component may be placed within the caulking gun's cradle so that the forward nipple extends forwardly through the cradle's front wall slot. Thereafter, and assuming the first attaching means comprise the preferred combination of a helically threaded nipple and a threaded clamping nut, such nut may be threadedly mounted over the nipple, and may be screw turned therealong until the forward wall of the cylinder becomes securely clamped against the cradle's forward wall. Thereafter, and assuming that the fourth attaching means comprise a rotatable coupling nut mounted to the rearward end of the flexible paint drawing tube, such tube may be securely attached to the exposed forward extension of the cylinder's nipple. Thereafter, the caulking gun's ram bar driving ratchet mechanism may be operated for forwardly moving the ram bar and attached plunger plate forwardly into the rearward opening of the cylinder, such motion causing the plunger plate to move forwardly within the cylinder into contact with the plunger, and to forwardly drive the plunger to the cylinder's front wall. Thereafter, the invention's third attaching means are preferably manipulated to securely attach the plunger plate to the plunger. Thereafter, the forward end of the flexible tube component may be inserted into a volume of liquid paint within, for example, a paint can. Thereafter, the operator may rearwardly draw the ram bar, such drawing action pulling rearwardly upon the plunger plate and plunger, and such action drawing the paint through the flexible paint drawing tube, thence through the cylinder's nipple, and thence into the cylinder's interior paint reservoir.

Upon filling of the reservoir with paint, the operator may disconnect the fourth attaching means and may set aside the flexible drawing tube. The operator may thereafter replace the paint drawing assembly with the above described paint conveying yoke, spindle, and roller combination. Upon secure attachment of such combination in place of the paint drawing tube, the operator may operate the paint gun's ram bar driving ratchet to forwardly drive the ram bar and plunger plate, and to simultaneously forwardly drive the plunger within the cylinder. Such forward driving action advantageously dispenses the paint out of the cylinder, through the nipple, and thence into and along the yoke's hollow conduit to emit into the interior space of the spindle. Thereafter, the paint passes through apertures within the spindle wall to charge the nap of the roller with paint. Thereafter, the assembled combination of the caulking gun and cylinder may serve as a handle for conventional roller painting. Successive actuations of the caulking gun's ratchet continuously charge the nap of the paint roller with paint, advantageously making less frequent the need for return trips to the paint can.

Accordingly, objects of the instant invention include the provision of an auxiliary caulking gun assembly which incorporates structures as described above, and which arranges those structures in relation to each other, as described above, for performance of the beneficial functions described above.

Other and further objects, benefits, and advantages of the instant invention will become known to those skilled in the art upon review of the Detailed Description which follows, and upon review of the appended drawings.

GENERAL STATEMENT REGARDING DRAWINGS

Drawing FIGS. 1-7 which are submitted herewith are primarily photographic in nature. The applicants respectfully assert that the photographic drawings are sufficient in detail and structure for purposes of examination of the application, and the applicants request that any Examiner's requirement of replacement of Drawing FIGS. 1-7 with regular black and white line drawings be held in abeyance until completion of examination.

DETAILED DESCRIPTION OF A PREFERRED EMBODIMENTS

Figure 6:
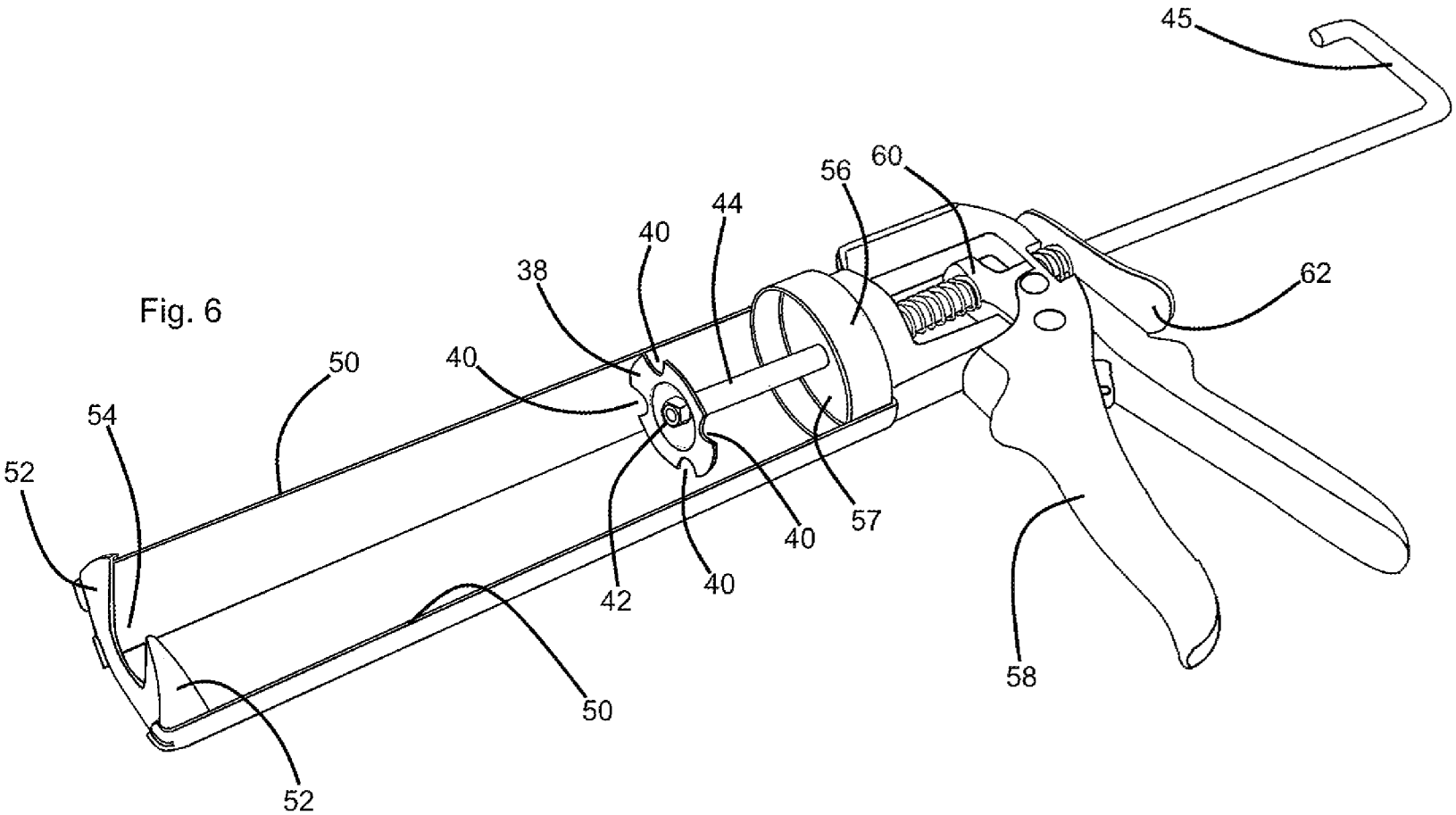
FIG. 6 depicts a conventional hand operated caulking gun which is suitable for use with the instant inventive auxiliary assembly.

Referring now to the drawings, and in particular to Drawing FIG. 6, a conventional caulking gun which is suitable for use with the instant inventive auxiliary assembly is shown, such caulking gun having a caulk tube receiving and supporting cradle or frame 50. Such cradle 50 has a forward tube stopping and retaining wall 52, such wall having an upwardly opening nipple clearance slot 54. A retainer flange 56 surrounding a rear wall 57 is fixedly attached to the rearward end of the cradle 50, the rear wall 57 slidably supporting a ram bar 44 for reciprocating forward and rearward movement. A ratchet mechanism 60 which is actuatable via alternating pivoting and counter-pivoting motions of grip 58 engages ram bar 44 for forwardly driving the ram bar 44 and its forward plunger plate 38. Depression of a latch release 62 in combination with application of a rearward pulling force to a turn hook 45 alternatively draws the bar 44 and plunger plate 38 rearwardly along the interior of cradle 50.

Figure 1:
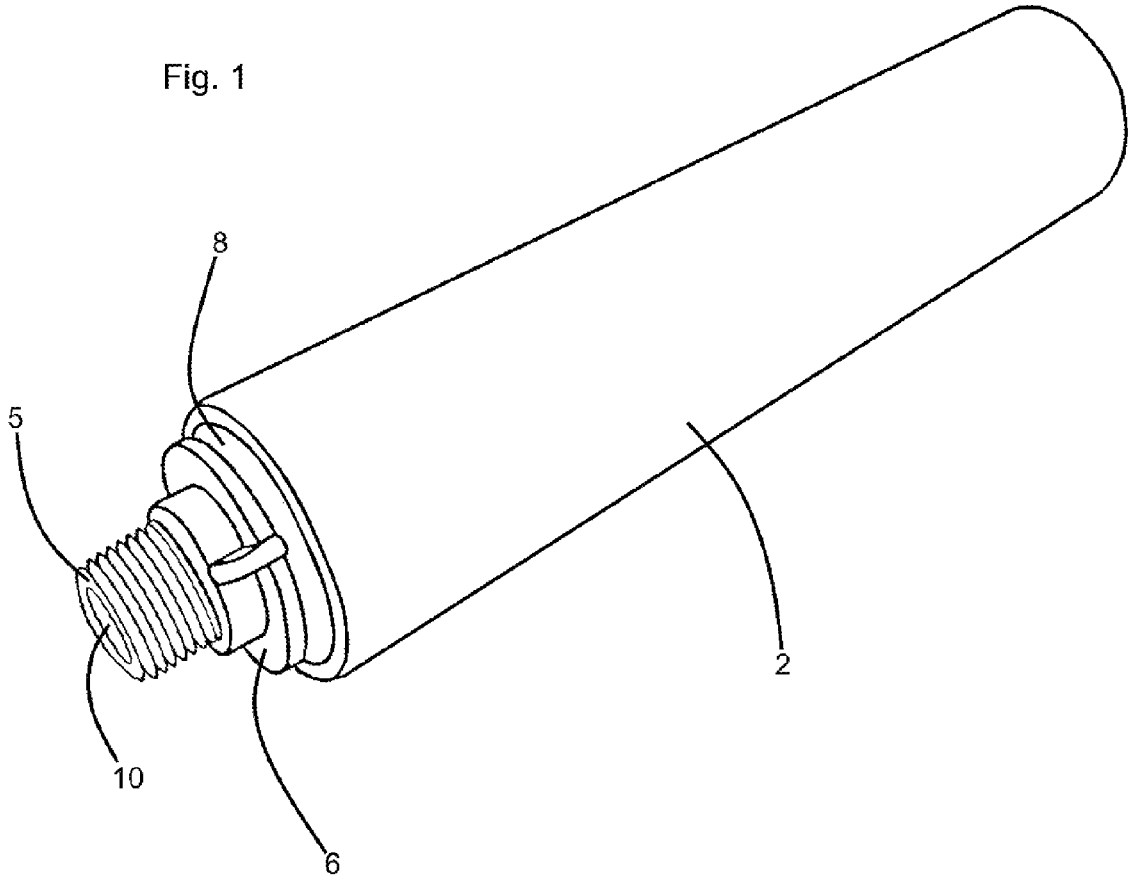
FIG. 1 is a perspective view of cylinder, nipple, and first attaching means components of the instant inventive auxiliary assembly.
Figure 2:
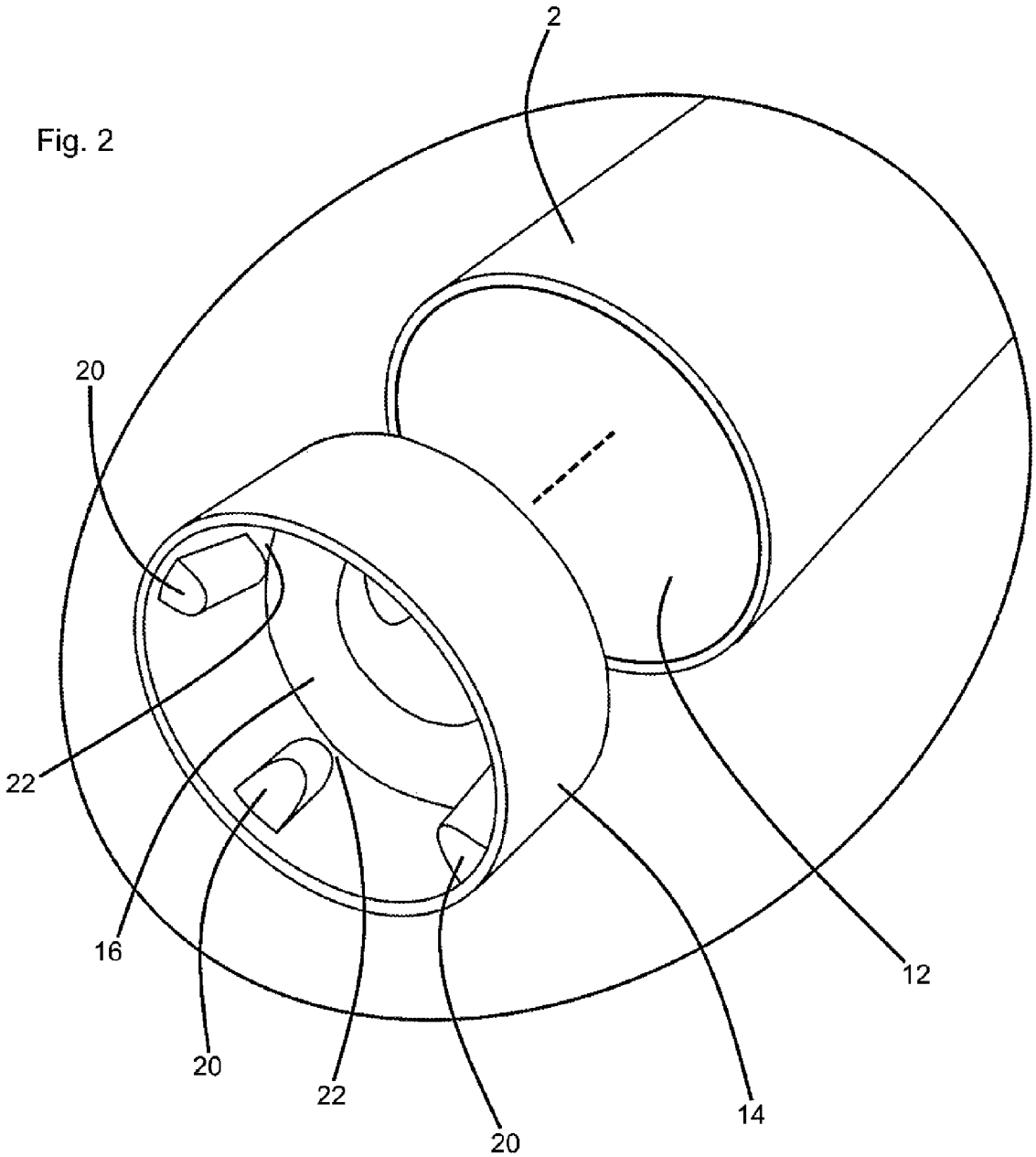
FIG. 2 presents a partial view of the rearward end of the cylinder of FIG. 1, the view further showing in exploded view a plunger component of the instant invention.

Referring simultaneously to FIGS. 1, 2, and 6, a first structural component of the instant inventive auxiliary assembly comprises a cylinder 2 which has a rearwardly opening hollow interior 12, and has a forward wall 8. A nipple 5 having a hollow bore 10 is fixedly attached to or formed wholly with the cylinder's forward wall 8, the rearward end of bore 10 communicating with the hollow interior 12 of the cylinder 2 for alternative drawing and dispensing of paint.

Figure 7:
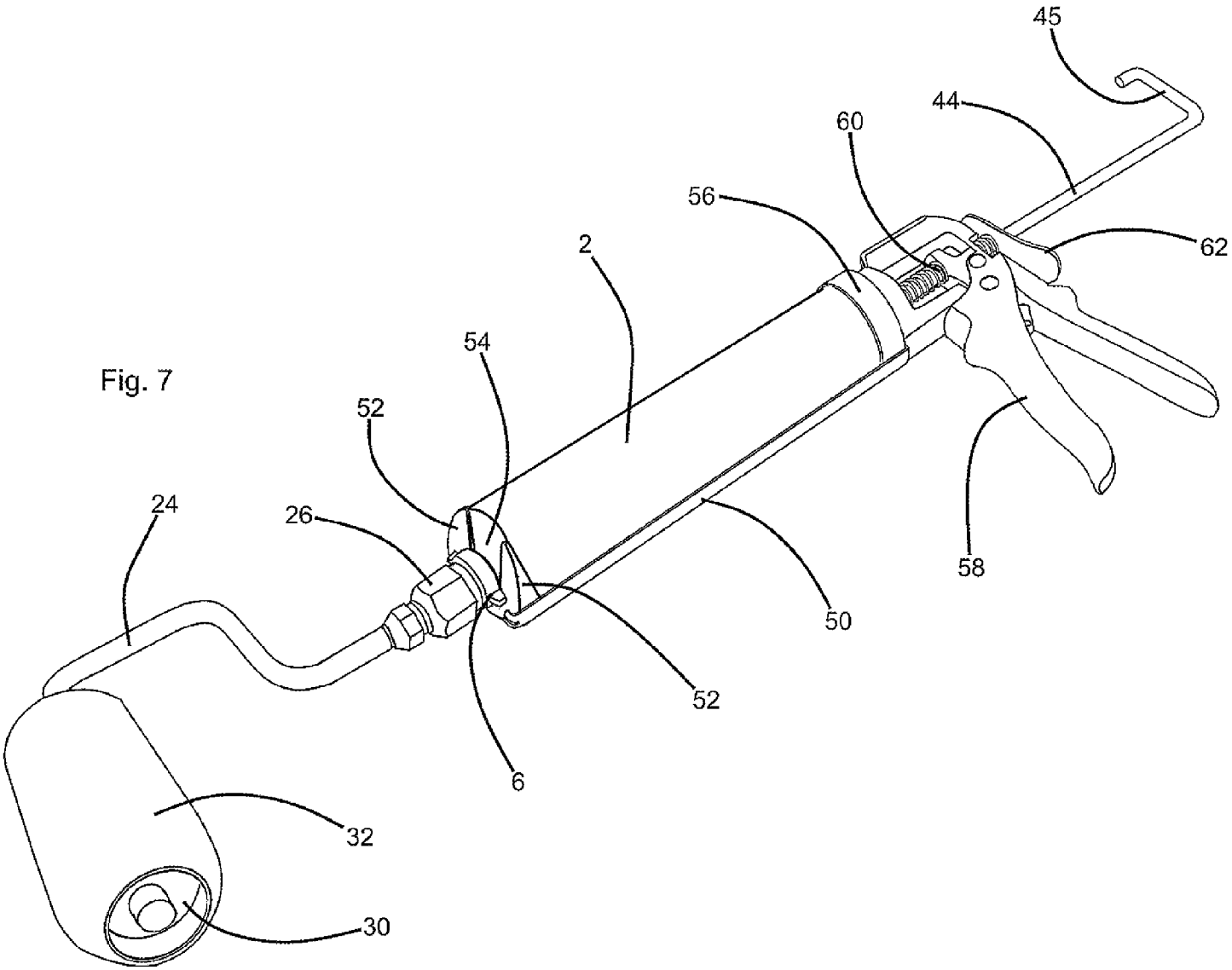
FIG. 7 shows the instant inventive auxiliary assembly as installed upon the caulking gun of FIG. 6.

Referring further simultaneously to FIGS. 1, 2, and 6, the instant inventive assembly preferably further comprises first attaching means which are preferably operatively connected to or wholly formed with the nipple 5. In a preferred embodiment, the first attaching means comprise a combination of exterior helical threads 4 and a clamp nut 6, such nut having interior helical threads fitted for engagement with threads 4. Referring further simultaneously to FIG. 7, upon placement of cylinder 2 within the cradle 50, and upon forward extension of the nipple 5 through slot 54, clamp nut 6 may be turned clockwise along threads 4 until the rearward face of nut 6 forcefully clamps against the forward face of stop wall 52, such clamping force securing the rearward face of stop wall 52 against the forward face of the cylinder's front wall 8. Accordingly, the invention's first attaching means may securely and releasably mount the cylinder 2 and nipple 5 combination to the cradle 50 of the caulking gun. The depicted first attaching means components are intended as being representative of other suitably substituted attaching means such as annular clamps and straps which may be alternatively used for holding cylinder 2 within cradle 50.

Figure 3:
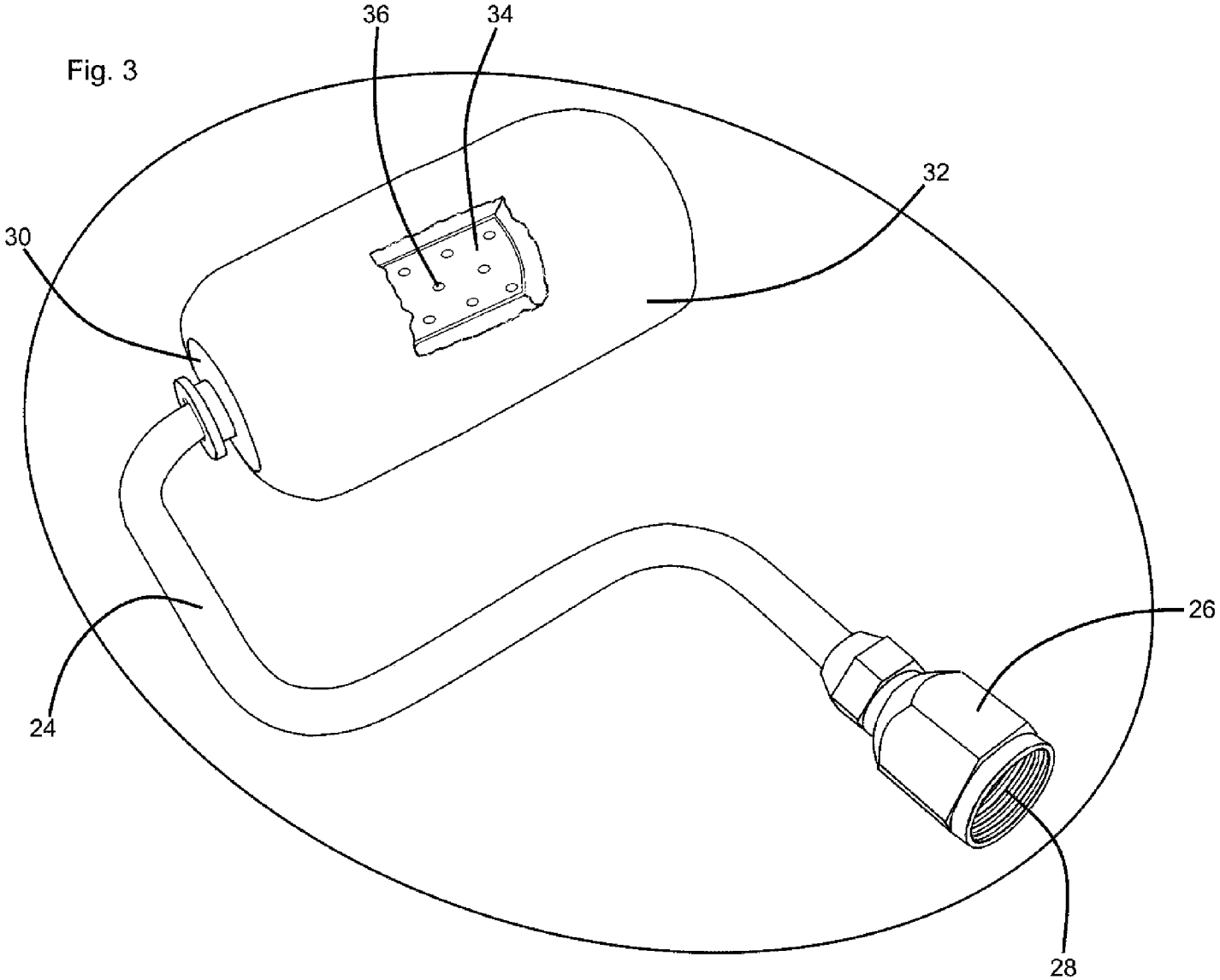
FIG. 3 is a perspective view of a roller, spindle, and paint conveying yoke combination of the instant inventive assembly.

Referring to FIG. 3, a further structural component of the instant inventive auxiliary assembly comprises a rigid hook shaped yoke 24, such yoke preferably comprising a hollow bored steel tube. Referring further simultaneously to FIG. 7, a hollow bored spindle 30 is rotatably mounted upon the transverse or laterally cantilevering end of the yoke 24, such spindle 30 preferably having a cylindrical wall 34 having a multiplicity of paint passage apertures 36. Paint roller nap 32 is preferably securely mounted about the exterior surface of the spindle 30,34.

Referring simultaneously to FIGS. 1, 3, and 7, the instant inventive auxiliary assembly preferably further comprises second attaching means which are preferably adapted for releasably attaching the rearward end of the yoke bar 24 to the nipple 5. In a preferred embodiment, such second attaching means comprise a rotatable coupling nut 26 having internal helical threads 28. Upon extension of nut 26 over nipple 5, and upon clockwise turning of nut 26, interior threads of nut 28 engage threads 4 of nipple 5 for securely mounting the roller 32, spindle 30,34, and yoke bar 24 combination upon the caulking gun and upon cylinder 2 in the manner depicted in FIG. 7.

Referring to FIG. 2, a further structural component of the instant inventive auxiliary assembly comprises a plunger 14 which is closely fitted to the hollow bore 12 of cylinder 2. Such close plunger fitting allows driving and drawing forces exerted against plunger 14 to reciprocatingly move the plunger within hollow bore 12, such motion causing the plunger 14 to alternatively drive and draw paint out of and into the interior reservoir of cylinder 2.

Figure 4:
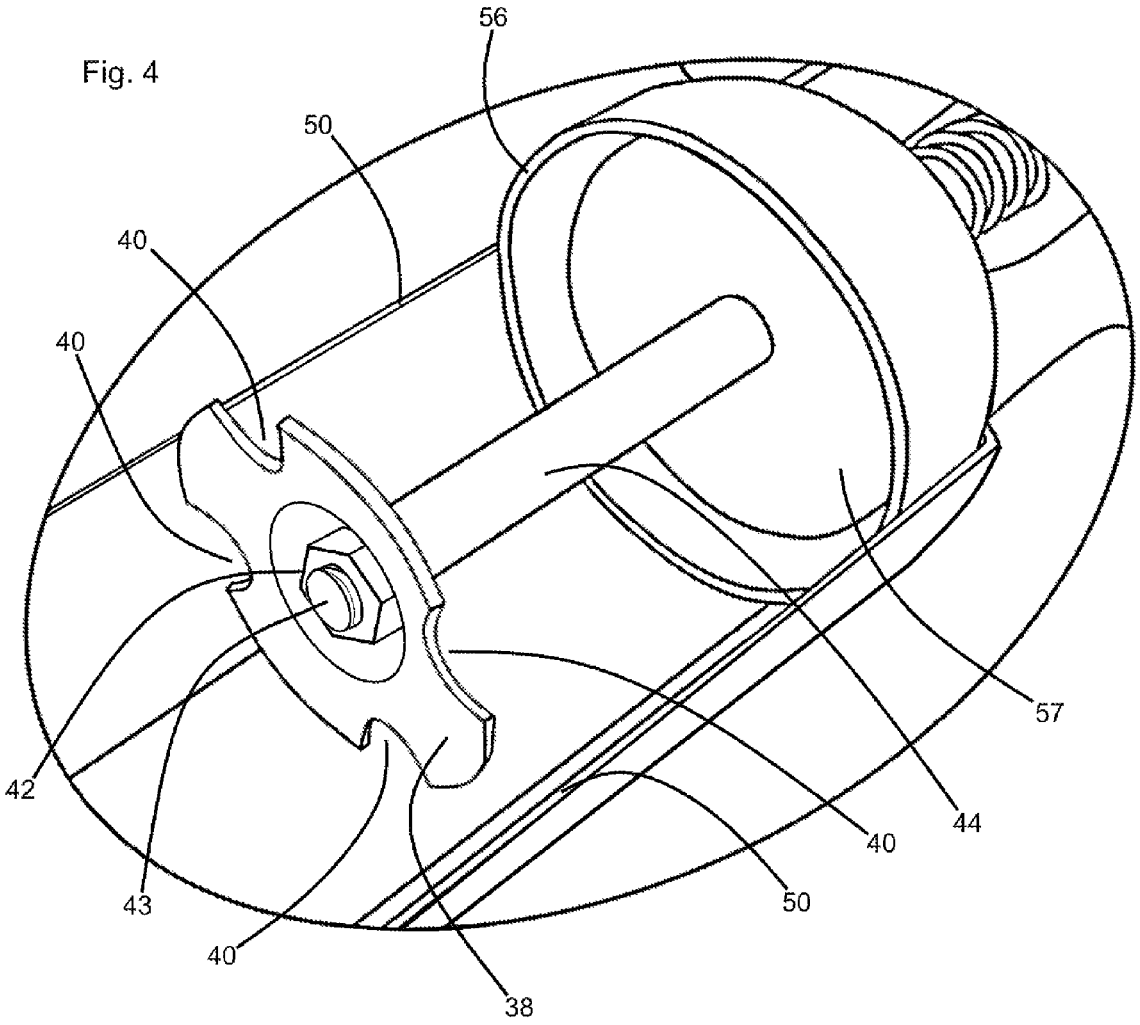
FIG. 4 depicts a plunger plate component of the instant inventive assembly, the view further showing conventional caulking gun components.

Referring simultaneously to FIGS. 2 and 4, the instant inventive auxiliary assembly preferably further comprises third attaching means which operatively interconnect the plunger 14 and the drive bar 44. In a preferred embodiment, the third attaching means comprise a plurality of hook ridges 20 which extend radially inwardly from the rearwardly extending circumferential wall of the plunger 14. A plurality of ridge clearance slots 40 open outwardly from the outer circumferential surface of plunger plate 38, the slots 40 preferably being fitted for facilitating through passages of the ridges 20. Upon insertion of plunger plate 38 into the interior 16 of plunger 14, clearance slots 40 may be initially aligned with ridges 20 so that the plunger plate 38 may further extend forwardly within space 16 until the forward face of plunger plate 38 contacts the rear surface of the front wall of plunger 14. Thereafter, referring further simultaneously to FIG. 7, a hook 45 at the rear end of ram bar 44 may be turned slightly, causing tab sections between plunger plate slots 40 to pass beneath the forward aspects of ridges 20, such plate tabs then functioning as hooking members within recesses 22. Upon such angular positioning of the ram plate 38, pushing and pulling forces applied to ram bar 44 are effectively translated to the plunger 14 for alternatively driving and drawing the plunger 14 within the hollow interior 12 of the cylinder 2. The combination of the ridges 20 and plunger plate slots 40 is considered as being representative of other commonly known releasable attaching means such as snap channel and snap ridge combinations and helically threaded joints which may alternatively suitably releasably attach the bar 44 to the plunger 14.

A helically threaded lug 43 at the forward end of bar 44 preferably extends through a central aperture within plunger plate 38, and such threaded lug 43 in combination with a helical threaded nut 42 are considered as comprising further preferred components of the instant invention's third attaching means. In practice, a wholly conventional caulking gun may be effectively retrofitted for use with the instant inventive assembly by removing such gun's conventional non-slotted plunger plate, and by replacing such plate with one modified to include ridge clearance slots 40.

Figure 5:
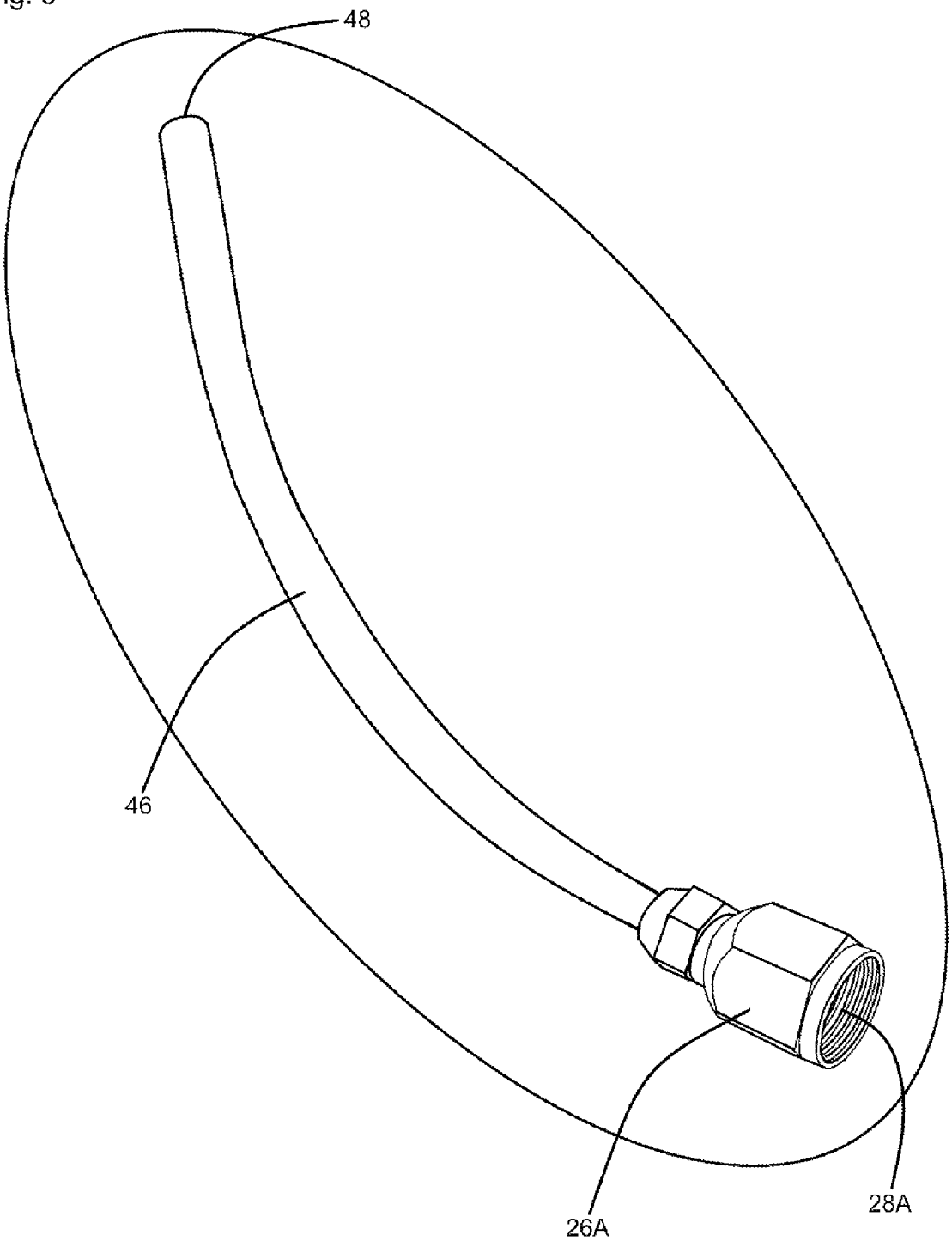
FIG. 5 depicts a flexible paint drawing tube and fourth attaching means elements of the instant inventive assembly.

Referring to FIGS. 1, 3, and 5, a further structural component of the instant auxiliary assembly preferable comprises a flexible paint drawing tube 46, such tube having an open forward end 48. Fourth releasable attaching means are preferably fixedly attached to the paint drawing tube's rearward end, such means preferably being configured substantially identically with the invention's second attaching means' rotatable coupling nut 26. Nut 26A is preferably substantially identical to the second attaching means' rotatable coupling nut 26, and helical threads 28A are alternatively engagable with nipple threads 4.

In use of the instant inventive auxiliary assembly, referring simultaneously to FIGS. 5 and 7, paint drawing tube 46 may be initially attached in place of the roller 32, spindle 30, and yoke 24 combination. With such tube attached, an operator may place the end of tube 46 within a paint can, and may draw rearwardly upon hook 45 and bar 44. Referring further simultaneously to FIGS. 2 and 4, such drawing action causes the hooked engagement of plate 38 with plunger 14 to move the plunger 14 rearwardly within cylinder 2 to create vacuum pressure which draws paint through tube 46 and into reservoir 12. Thereafter, the operator may convert the assembly to the use configuration of FIG. 7. Actuation of trigger grip 58 causes ratchet mechanism 60 to drive bar 44, plunger plate 38, and plunger 14 forwardly within cylinder 2 to drive the paint through yoke 24, then into spindle 30, and thence into the paint roller's nap 32, effectively charging the paint roller with paint.

Upon such charging of the paint roller with paint, the cylinder 2 and cradle 50 combination effectively serves as a manually graspable handle for performance of roller painting. In the event that the nap 32 of the roller becomes dry, the operator may re-actuate grip 58 for further charging the roller with paint.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A paint applicator for attachment to a caulk gun, the caulk gun comprising a cradle having front and rear ends, a stop fixedly attached to the cradle's front end, a bar having front and rear ends, and ratchet means comprising a pivotable grip, the ratchet means operatively positioning the bar's front end within the cradle for forwardly moving upon the pivoting of the grip, the paint applicator comprising:

(a) a rearwardly opening cylinder having a hollow bore and a front wall, the cylinder being fitted for insertion into the cradle;

(b) a nipple further opening the cylinder at the cylinder's front wall;

(c) a piston slidably mounted within the cylinder;

(d) first attaching means adapted for, upon the insertion of the cylinder into the cradle, resisting removal of the cylinder from the cradle;

(e) a yoke having a hollow bore, the yoke having paint inlet and paint outlet ends;

(f) second attaching means adapted for attaching the yoke to the nipple;

(g) a paint roller and spindle combination rotatably mounted upon the yoke's outlet end for receiving paint and rollably applying the paint; and (h) third attaching means operatively interconnecting the piston and the bar's front end, the third attaching means being adapted for, upon rearward movements of the bar and the bar's front end, rearwardly drawing the piston.

2. The paint applicator of claim 1 wherein the third attaching means comprise a plate fixedly attached to the bar's front end and at least a first hook adapted for releasably interconnecting the plate and the piston.

3. The paint applicator of claim 2 wherein the plate comprises an alternating slot and tab section series, the at least first hook comprising said series' tab sections.

4. The paint applicator of claim 3 wherein the piston has a rearwardly extending circumferential wall, and further comprising a plurality of hook ridges extending inwardly from said wall, each hook ridge being releasably engageable with one of the tab sections.

5. The paint applicator of claim 4 wherein each slot among the alternating slot and plate edge series is fitted for receiving one of the hook ridges.

6. The paint applicator of claim 1 wherein the first attaching means comprise external helical threads engagable with an internally helically threaded nut, said nut being adapted for, upon the insertion of the cylinder into the cradle, clamping against the stop.

7. The paint applicator of claim 6 wherein the external helical threads extend from the nipple.

8. The paint applicator of claim 7 wherein the yoke comprises rigid steel tubing.

9. The paint applicator of claim 8 wherein the yoke is hook configured.

10. The paint applicator of claim 9 wherein the second attaching means comprise a rotatable coupling nut adapted for engagement with the nipple's external helical threads.

11. The paint applicator of claim 1 further comprising a paint drawing tube and tube attaching means, the tube attaching means being adapted for interconnecting the paint drawing tube and the nipple.

12. The paint applicator of claim 11 wherein the tube attaching means comprise a rotatable coupling nut.

* * * * *